US007419301B2

(12) United States Patent
Schneider et al.

(10) Patent No.: US 7,419,301 B2
(45) Date of Patent: Sep. 2, 2008

(54) TAMPER-EVIDENT EASY-OPEN SLIDER PACKAGE AND RELATED METHODS OF MANUFACTURE

(75) Inventors: John H. Schneider, Frankfort, IL (US); Steven Ausnit, New York, NY (US)

(73) Assignee: Illinois Tool Works Inc., Glenview, IL (US)

( * ) Notice: Subject to any disclaimer, the term of this patent is extended or adjusted under 35 U.S.C. 154(b) by 832 days.

(21) Appl. No.: 10/042,985

(22) Filed: Oct. 19, 2001

(65) Prior Publication Data

US 2003/0041563 A1 Mar. 6, 2003

Related U.S. Application Data

(60) Provisional application No. 60/316,353, filed on Aug. 31, 2001.

(51) Int. Cl.
*B65D 65/30* (2006.01)
*B65D 33/34* (2006.01)

(52) U.S. Cl. ..... 383/209; 383/61.3; 383/64; 493/214; 493/927; 53/412

(58) Field of Classification Search ..... 383/5, 383/63, 64, 61.2, 61.3, 203, 204, 207, 209; 53/139.2, 133.4, 412; 493/213, 214, 927
See application file for complete search history.

(56) References Cited

U.S. PATENT DOCUMENTS 3,225,869 A * 12/1965 Schibli ..... 187/382
3,545,668 A * 12/1970 Hultberg ..... 383/204
4,147,583 A * 4/1979 Deutschlander ..... 156/510
4,498,591 A * 2/1985 Smith, II ..... 383/209
4,509,196 A * 4/1985 Sak et al. ..... 383/5
4,682,976 A * 7/1987 Martin et al. ..... 53/133.8
4,759,643 A * 7/1988 Canno ..... 383/84
5,085,031 A 2/1992 McDonald
5,371,997 A * 12/1994 Kopp et al. ..... 53/412
5,400,568 A * 3/1995 Kanemitsu et al. ..... 53/412
5,456,928 A 10/1995 Hustad et al.
5,630,308 A * 5/1997 Guckenberger ..... 53/412

(Continued)

FOREIGN PATENT DOCUMENTS

WO WO 01/19695 A1 3/2001
WO WO 02/12064 A1 2/2002

*Primary Examiner*—Thanh K Truong
(74) *Attorney, Agent, or Firm*—Ostrager Chong Flaherty & Broitman P.C.

(57) ABSTRACT

A reclosable packaging having a slider/zipper assembly and a sealed header. The header has a tear notch for initiating tearing of the header material and a line of weakness for continued tearing of the header material at an elevation which is lower than the top of the slider. Most preferably, the line of weakness is lower than the bottom of the slider. When the header is torn along the line of weakness, at least part of the slider is exposed and accessible to the consumer. In one embodiment, the tear notch is located in a side edge at an elevation higher than the top of the slider. A slit is provided which traverses a range of elevations encompassing a first elevation near an elevation of the tear notch and a second elevation near an elevation of the line of weakness.

14 Claims, 5 Drawing Sheets

U.S. PATENT DOCUMENTS

| | | | | |
|---|---|---|---|---|
| 5,660,479 | A | 8/1997 | May et al. | |
| 5,711,609 | A * | 1/1998 | Simonsen | 383/63 |
| 5,713,669 | A * | 2/1998 | Thomas et al. | 383/204 |
| 6,273,607 | B1 * | 8/2001 | Buchman | 383/5 |
| 6,290,390 | B1 | 9/2001 | Buchman | 383/5 |
| 6,290,391 | B1 | 9/2001 | Buchman | 383/5 |
| 6,327,837 | B1 * | 12/2001 | Van Erden | 53/412 |
| 6,347,885 | B1 | 2/2002 | Buchman | 383/5 |
| 6,360,513 | B1 | 3/2002 | Strand et al. | 53/412 |
| 6,461,043 | B1 * | 10/2002 | Healy et al. | 383/204 |
| 6,467,956 | B1 * | 10/2002 | Tilman et al. | 383/61.3 |
| 6,517,242 | B1 * | 2/2003 | Buchman | 383/5 |
| 2001/0017947 | A1 | 8/2001 | Strand et al. | |
| 2002/0076122 | A1 | 6/2002 | Buchman | 383/5 |
| 2004/0264816 | A1 * | 12/2004 | Carter | 383/207 |

* cited by examiner

TAMPER-EVIDENT EASY-OPEN SLIDER PACKAGE AND RELATED METHODS OF MANUFACTURE

RELATED PATENT APPLICATION

This application claims the benefit, under Title 35, United States Code, § 119(e), of U.S. Provisional Application No. 60/316,353 filed on Aug. 31, 2001.

FIELD OF THE INVENTION

The present invention relates to reclosable packaging and in particular to such packaging wherein indicia are provided to indicate the first opening of the package. In particular, the invention further relates to methods for forming a reclosable package having a resealable closure, especially as part of a form, fill and seal process.

BACKGROUND OF THE INVENTION

In the use of plastic bags and packages, particularly for foodstuffs, it is important that the bag be hermetically sealed until the purchaser acquires the bag and its contents, takes them home, and opens the bag or package for the first time. It is then commercially attractive and useful for the consumer that the bag or package be reclosable so that its contents may be protected. Flexible plastic zippers have proven to be excellent for reclosable bags, because they may be manufactured with high-speed equipment and are reliable for repeated reuse.

A typical zipper is one which has a groove at one side of the bag mouth and a rib at the other side, which rib may interlock into the groove when the sides of the mouth of the bag are pressed together. Alternatively, a member having a plurality of ribs may be on one side of the bag mouth, while a member having a plurality of channels may be on the other side, the ribs locking into the channels when the sides of the mouth of the bag are pressed together. In such a case, there may be no difference in appearance between the two members, as the ribs may simply be the intervals between channels on a strip which may lock into another of the same kind. In general, and in short, some form of male/female interengagement is used to join the two sides of the bag mouth together. The so-called members, or strips, are bonded in some manner to the material from which the bags themselves are manufactured. Usually, pull flanges extend above the rib and groove strips, which pull flanges may be pulled apart for access to the interior of the bag.

Although flexible zippers of this variety are quite popular, they do not always prevent the inadvertent or unwelcome opening of a bag or package within the store, and various additions have been made to provide tamper-evident seals which would reveal when it has been opened prior to purchase. The problem of providing a tamper-evident zipper is exacerbated in package designs wherein the zipper is provided with a slider. While a slider facilitates a consumer opening and reclosing the package and hence is desirable in some instances, the slider makes it difficult for the manufacturer to employ conventional techniques to render the package tamper evident.

It is known to provide a zipper package construction which is designed to undergo some permanent change in the package appearance when the package is opened for the first time. In particular, it is known to provide a zipper package with a sealed header which extends over the zipper and encloses the zipper and slider. For example, the header may comprise extensions of the front and rear package walls, the extensions being joined by a seal. The seal may be a peel seal, which may be readily ruptured by a consumer to expose the zipper and slider, or a "hard" seal, the latter being a seal that is not intended to be broken. In the case of a header formed using a hard seal, it is known to provide the package header with one or more lines of perforations which must be torn open by a consumer to obtain access to the slider. In place of a line of perforations (or to facilitate tearing the package along the line of perforations), it is also known to provide one or more notches at a side edge of the header for starting a tear across the header. In any event, the header must be opened before access can be had to the slider and zipper. If a package evidences a torn header before the package is purchased by a consumer, this should indicate to the consumer that the package has been tampered with, e.g., previously opened.

Zipper package constructions with sealed headers should also have other desirable features. For example, the package should be "user friendly" in the sense that the steps necessary for the initial opening of the package prior to the use of the zipper are obvious or intuitive to the consumer. Also the zipper package design should allow the package to be formed on conventional packaging equipment with little or no modification of the equipment being required.

SUMMARY OF THE INVENTION

The present invention is directed to a reclosable packaging comprising a slider/zipper assembly and an enclosed header, the header in turn comprising means for initiating tearing of the header material and means for continued tearing of the header material at an elevation which is lower than the top of the slider, and most preferably, which is lower than the bottom of the slider. Although it is not necessary for the tear line to be located below the slider, the tear line must be low enough to expose enough of the slider that the consumer can grip the slider without interference from the remnants of the torn header. The enclosed header may comprise two or more pieces sealed together or one folded piece.

In accordance with one preferred embodiment of the invention, the means for initiating tearing of the header material comprise a tear notch located at an elevation higher than the top of the slider and the means for continued tearing of the header material comprise respective lines of weakness extending across the package at an elevation below the top of the slider on both walls of the header. The header further comprises means for diverting tearing of the header material from the vicinity of the tear notch to the lines of weakness. These tear diverting means preferably take the form of respective slits having an end point in the vicinity of the termination of the tear notch and an end point in the vicinity of the respective lines of weakness. More generally, each slit should traverse a range of elevations encompassing a first elevation near an elevation of the tear notch and a second elevation near an elevation of the respective line of weakness. In accordance with alternative preferred embodiments, lines of weakness can be substituted for the slits. Thus, by pulling on the portion of the header above the tear notch, a consumer can cause the header to tear in the front and the back along the lines of weakness, until the upper portion of the torn header is severed from the lower portion, thereby exposing the slider and zipper.

The present invention further encompasses a method of packaging product using an automated form, fill and seal process. The preferred method comprises the following steps: slitting a continuous length of packaging film at successive package length intervals, first and second pairs of slits being made in the packaging film for each package length interval, none of the slits reaching an edge of the packaging film; attaching successive slider/zipper assemblies to the packaging film, one slider/zipper assembly being attached to the packaging film for each package length interval, each slider/zipper assembly overlying at least one pair of slits; forming the packaging film into successive packages, each package having a respective slider/zipper assembly; filling each package with product; and sealing each filled package. In accordance with the preferred embodiment, the first pair of slits are generally parallel to and overlying the second pair of slits after the forming step. The method further comprises the step of forming first and second lines of weakness in the packaging film, the first line of weakness being generally parallel to and overlying the second line of weakness after the forming step, with the end points of the first line of weakness being adjacent to respective end points of the slits of the first pair which are closest together and with the end points of the second line of weakness being adjacent to respective end points of the slits of the second pair which are closest together. The preferred method further comprises the step of forming a tear notch along a side edge of each package, the tear notch being placed at an elevation generally aligned with an elevation of points along the slits in each package. The slider/zipper assembly can be oriented in either a machine direction or a cross or transverse direction when attached to the packaging film.

Each line of weakness for tearing off the header may comprise a line of spaced slits, a line of spaced perforations, a continuous or discontinuous score-line of thinned header material (formed, e.g., by laser scoring), a continuous or discontinuous line of pre-weakened header material, or any equivalent structure for providing a line of preferential tearing. The line of weakness preferably extends horizontally across the width of the package at an elevation lower than the bottom of the slider, although the invention is broad enough to encompass placement of the transverse line of weakness at an elevation between the top and bottom of the slider.

Reclosable packaging having a sealed header incorporating the foregoing features may comprise a receptacle formed by front and rear walls joined by side seals. The features disclosed herein may also be used in pouches or bags having other configurations, e.g., bags with bottom and side panels. The sealed header may be integrally formed with or heat sealed (i.e., fused) to the front and rear walls of the receptacle. The zipper typically comprises a pair of complementarily profiled, plastically extruded fastener strips. One fastener strip, comprising an interlockable member having a first profile, is attached to the front wall of the packaging; the other fastener strip, comprising an interlockable member having a second profile, is attached to the rear wall of the receptacle. The second interlockable member is interlocked with the first interlockable member for closing the mouth at the top of the receptacle. A slider is slidably positioned over the interlockable portions of the fastener strips for movement along the zipper from side to side of the package. The slider causes the profiled interlockable members to disengage when moved in the direction of the closing end of the slider, allowing access to the contents of the packaging, and causes the profiled interlockable members to interlock when moved in the direction of the opening end of the slider.

Other aspects of the invention are disclosed and claimed below.

DETAILED DESCRIPTION OF THE PREFERRED EMBODIMENTS

Figure 1:
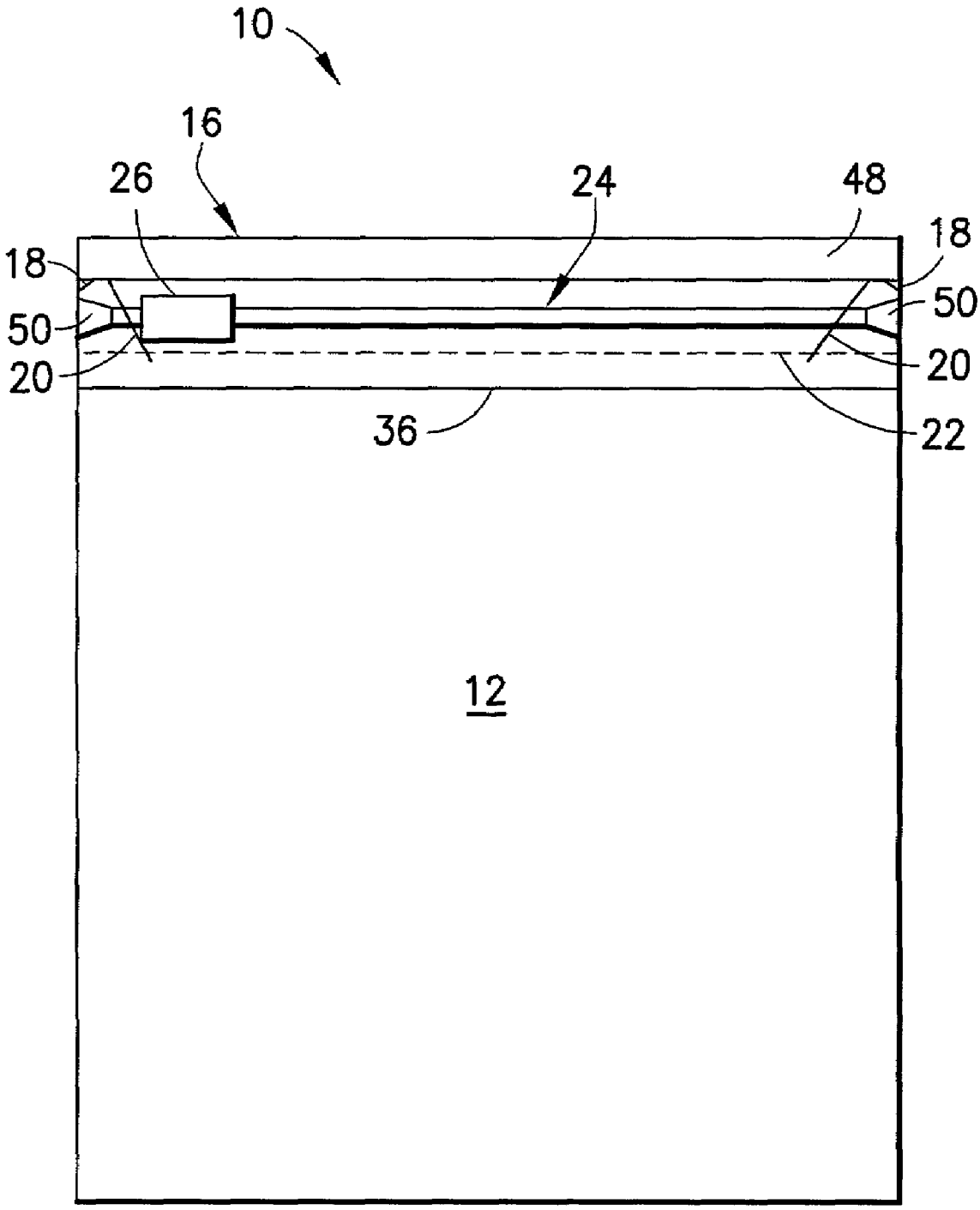
FIG. 1 is a drawing showing a front view of a reclosable package in accordance with one preferred embodiment of the invention.

Reference will now be made to the drawings in which similar members in different drawings bear the same reference numerals. FIG. 1 depicts a reclosable package 10 comprising a receptacle with a mouth at the top, the receptacle being formed by a front wall 12 and a rear wall (not shown) that is opposite to the front wall. The front and rear walls are typically formed from clear thermoplastic film heat sealed as necessary to form hermetically sealed junctures for the various portions of the package, e.g., along the sides if folded along the bottom or along a central seam and along the bottom if folded along the sides. A zipper 24 comprising a pair of fastener strips having a respective interlockable members is provided in the mouth of the receptacle, attached to the front of wall 12 and rear wall. A slider 26 is provided on the zipper to facilitate its opening and closing. FIG. 1 shows disengages the interlockable members of the zipper and moving the slider back to the closed position shown in FIG. 1 brings the interlockable members of the zipper into full engagement once again. For proper functioning, the interlockable members have spot seals 50 at the ends of the zipper strips. These seals ensure the zipper strips will not come apart during use and provide end stops for the slider 26. The slider-zipper assembly is preferably covered on the consumer side by an enclosed header 16 that is sealed at the top edges to form seal 48. The sealed header 16, which provides a tamper-evident feature, comprises front and rear walls that may be integrally formed with or heat sealed to the front and rear walls, respectively, of the receptacle. The sealed header 16 has respective tear notches 18 formed on each side edge of the header, at which the consumer can initiate tearing off of the sealed header from the package.

It should be appreciated that the front wall of the header 16 and the front wall 12 of the receptacle are shown in FIG. 1 as being made of clear thermoplastic material. Therefore, the slider-zipper assembly is visible through the clear walls and has not been depicted as hidden.

In accordance with one preferred embodiment, the header 16 has a respective tear notch 18 (see FIG. 1) formed on each side edge at an elevation which is higher than the top of the slider. A line of weakness 22, indicated by a dashed line, is formed in the front wall of the sealed header 16. The line of weakness 22 is preferably straight and generally parallel to the zipper line, extending horizontally from one side edge of the package to the other. As shown in FIG. 1, the line of weakness 22 is located at an elevation lower than the bottom of the slider 26. A similar or identical line of weakness is formed in the rear wall of the header. The purpose of these lines of weakness is to provide lines of preferential tearing which will allow the majority of the sealed header 16 to be torn off the package, thereby exposing the slider and zipper.

In accordance with the preferred embodiment depicted in FIG. 1, a pair of slits 20 are formed in the front wail of the header. Another pair of slits (not shown in FIG. 1), disposed and oriented to mirror the slits in the front wall, are formed in the rear wall of the header. Tear notches 18 are formed above the zipper at the edges of the bag walls. Each slit 20 in the front wall of the header has a point located near (both laterally and elevationally) the termination point of a respective tear notch 18 and another point located at an elevation which is near the elevation of the line of weakness 22 formed in the front wall of the header. The slits in the rear wall of the header are similarly disposed relative to the tear notches 18 and relative to the line of weakness formed in the rear wall of the header. In particular, each slit 20 extends in the elevation direction from a point generally level with the terminations of the tear notches 18 to a point generally level with the corresponding line of weakness. It will be appreciated, however, that the upper end of each slit may extend to an elevation above the elevation of the tear notch without having an adverse impact on the ability of a tear propagating from the tear notch to meet or connect with the slit. Preferably the lower end of each slit does not extend below the associated line of weakness.

As seen in FIG. 1, the slits 20 are inclined at an angle of less than 90 degrees relative to the zipper line, i.e., the direction of slider travel, and have a lower termination point which is further from the nearest side edge of the receptacle than is the upper termination point of the slit. The preferred angle of inclination of the slit relative to the zipper line lies in the range of 30 to 90 degrees, with the most preferred angle being 45 degrees. If an angle of or close to 90 degrees is used, the tear notch must be deepened to accommodate that steep angle. Alternatively, lines of weakness may be employed in place of slits, provided that such lines of weakness yield easily when the consumer tries to tear the header open, e.g., by pulling an upper corner of the sealed header toward the opposite upper corner of the header. Again, such a line of weakness may comprise a line of spaced slits, a line of spaced perforations, a continuous or discontinuous score-line of thinned header material, a continuous or discontinuous line of pre-weakened header material, or any equivalent structure for providing a line of preferential tearing. However, a single inclined continuous slit is the most preferred embodiment since no tearing is required along the inclined line. The strategically placed slit 20 diverts the tearing action initiated at the elevation of the tear notch 18 down to the elevation of the line of weakness 22. This occurs on both faces of the header as one corner is torn, allowing a major portion of the header to be torn away from the package along a pair of horizontal lines at an elevation lower than the bottom of the slider.

Figure 2:
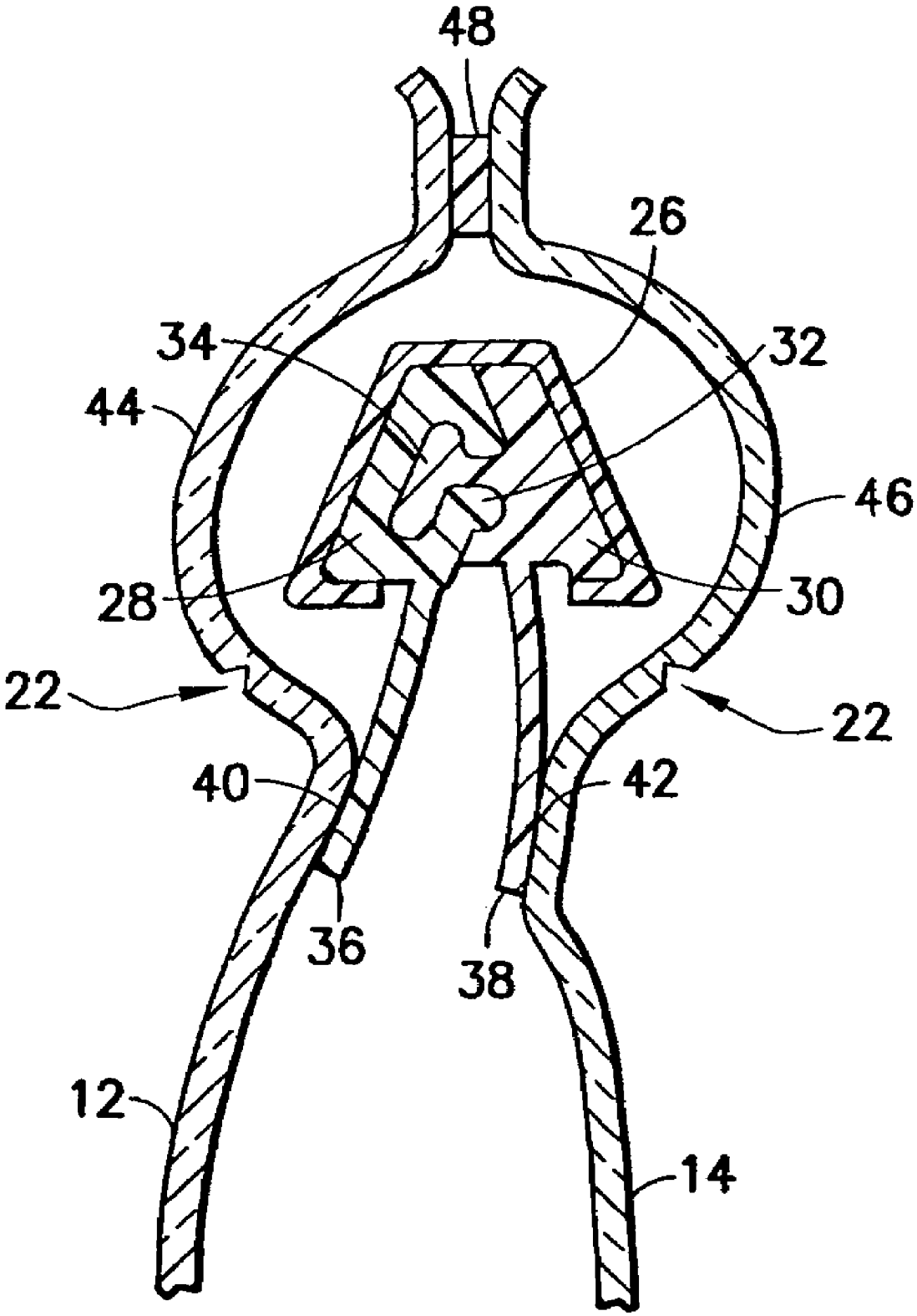
FIG. 2 is a drawing showing a fragmentary sectional view of the zippered portion of a reclosable package in accordance with the preferred embodiment depicted in FIG. 1.

Referring to FIG. 2, it can be seen that the zipper 24 consists of a first fastener strip 28 and a second fastener strip 30. Fastener strip 28 is provided with a first interlockable member 32 and fastener strip 30 is provided with a second interlockable member 34 that is engageable with the first interlockable member 32. Numerous configurations for the interlockable members 32, 34 are well known in the art. Fastener strip 28 further includes a flange 36 that extends toward the interior of the package and fastener strip 30 further includes a similar flange 38. Flange 36 is attached to receptacle wall 12 by a hard seal 40. Similarly, flange 38 is attached to receptacle wall 14 by a hard seal 42. Further, the receptacle wall 12 includes a portion 44 that extends past and above the seal point 40 to form the front wall of the header; similarly, the receptacle wall 14 includes a portion 46 that extends past and above the seal point 42 to form the rear wall of the header. Alternatively, the front and rear walls 44 and 46 of the header could be hard sealed or heat fused to the front and rear walls 12 and 14, respectively, of the receptacle if a separate folded strip is used.

Optionally, the preferred embodiments of the invention may include an internal hermetic peel seal. The internal hermetic peel seal may be provided by extending one of the zipper flanges to form a web. The distal edge of the web is sealed to the opposing wall of the receptacle by means of a layer of peel seal material. The side edges of the web are captured in the side seals for the front and rear walls of the receptacle, thereby ensuring that the web is caulked on all sides to hermetically seal the package contents.

The present invention further encompasses methods of packaging product using any one of the known form-fill-seal methods, such as HFFS (horizontal form-fill-seal), VFFS (vertical form-fill-seal) with the zipper applied in either the machine or transverse direction, or HFVFS (horizontal form/vertical fill-seal). In general, the preferred method of packaging product using a form, fill and seal automated process comprises the following steps: forming two pairs of slits in each successive package length interval of a continuous length of packaging film (no slit reaching an edge of the packaging film); attaching one slider/zipper assembly to the packaging film for each package length interval, each slider/zipper assembly overlying the first pair of slits; forming the packaging film into successive packages, each package having a respective slider/zipper assembly, the second pair of slits overlying the slider/zipper assembly and being generally aligned with the first pair of slits; filling each package with product; and sealing each filled package. The slider/zipper assembly can be oriented in either a machine direction or a transverse (cross) direction when attached to the packaging film.

A known VFFS technique is disclosed in U.S. Pat. No. 4,909,017 to McMahon et al. In accordance with the disclosed technique, a continuous supply of thin packaging or bag-making film is fed forwardly of a supply roll. As the film is fed forwardly to the form, fill and seal machine, a fastener strip assembly is attached to the inner surface of the film. The fastener strip may be laid directly on the film, but preferably is fed laterally across the upper surface of the film at right angles to the longitudinal edges of the film, or in other words at right angles to the longitudinal formation axis of the film. The fastener strip is provided from a supply roll fed through a guide and into a channel. Suitable means are provided for cutting off a length of fastener strip from the film and the length of the strip will be substantially equal to one-half of the film width. The strip is secured or attached to the film so that only the lower portion, i.e., the flange, of the profiles is secured to the film. The strips are attached at midpoint of the edges of the film and the lateral portions of the film beyond the ends of the strips are sufficiently long so that they can be folded over the top of the strips. After the zipper assembly has been applied, the film is fed downwardly over shaping shoulders to guide the film over a vertical forming and filling tube. The edges of the film are brought together and are pressed together by rollers to form a flange seam. The seam is welded by heated welding bars which are brought together against opposite sides of the fin seam. Product is dropped through the tube into the tubular formed bag which has a lower seam. When the contents are in the tube, the top of the bag is completed.

Figure 3:
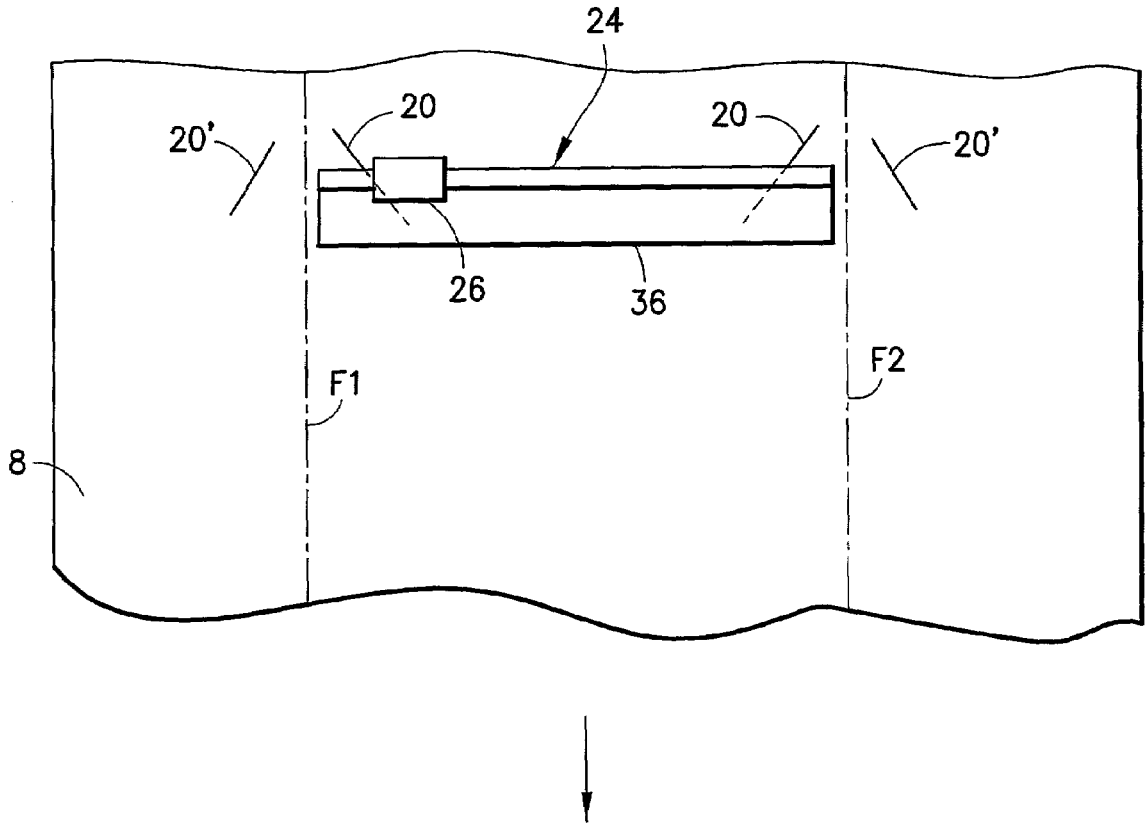
FIG. 3 is a drawing showing a fragmentary top view of a slide/zipper assembly attached to a slitted packaging film and oriented in a transverse direction in accordance with one preferred method of packaging product on a form, fill and seal machine.

A VFFS method of the above-described type can be supplemented in accordance with one preferred embodiment of the invention by automatically slitting the packaging film, as shown in FIG. 3, prior to forming. Preferably, two slits 20 and two slits 20' are formed. Then the slider/zipper assembly 24/26 is attached to the film in overlying relationship to the slits 20. The film is then advanced to the folding station. The advancement of the packaging film occurs in the direction indicated by the arrow in FIG. 3. The fold lines are indicated by the dot-dash lines labeled F1 and F2 respectively. In the embodiment shown in FIG. 3, the slits 20' are preferably formed in mirror relationship to the slits 20 about the fold lines F1 and F2 respectively. When the film is folded along fold lines F1 and F2, the slits 20' will generally overlie the corresponding slits 20. In the final package, the slits 20 and 20' will be part of a sealed header. The slits 20 will be in the front wall of the header, while the slits 20' will be in the rear wall of the header.

The invention also may be employed in HFVFS processes. U.S. Pat. No. 6,138,439 to McMahon et al. discloses techniques for making slide-zippered packages on a horizontal form-vertical fill-seal machine. Package film is paid off a roll of the same. Downstream a pull roller is provided for driving the film through the machine. A folder plow positioned downstream of the film roll folds the package film about a bottom crease to form opposing package walls. Interlocked reclosable zippers are then paid off a roll of the same and fed between the advancing package walls. Sliders are inserted onto the reclosable zippers prior to the folder plow at package width intervals, at what will be the closing end of the zipper, by a slider insertion mechanism at a slider insertion station. The sliders are supplied from a slider coil. At a first sealing station, the zipper flanges are sealed to the opposing package walls. Then at stomping stations, the ends of the zipper for a given package are stomped. At a second sealing station, the folded film and zipper are cross-sealed to form discrete packages. Each package is then opened, cut into individual packages, and filled. After each package is filled, the slider is moved backed to the closing end of the zipper. Finally, a tamper-evident seal is provided by sealing the film extensions above the zipper to form a header which encloses the slider-zipper assembly.

An HFVFS method of the above-described type can be supplemented in accordance with another preferred embodiment of the invention by automatically slitting the packaging film before it is folded by the folder plow. The person skilled in the art will recognize that the two pairs of slits must be placed so that the respective slits of the pairs of slits are generally mutually parallel and in overlying relationship after the film has been folded by the folder plow. Then the slider/zipper assembly is attached to the film in overlying relationship to the slits. In the final package, the slits will be part of the enclosed header.

A known HFFS technique is disclosed in U.S. Pat. No. 4,876,842 to Ausnit. The '842 patent discloses a form, fill and seal machine comprising a product mass loading station, a product mass enclosing and film sealing station, and a cross sealing and package separation station. A continuous length of packaging film derived from a supply roll is run successively through the work stations starting at the loading station. In the loading station, where the film is spread out substantially flat, product masses are successively deposited on the film at substantially uniformly spaced intervals. Adjacent to the loading station there is joined, in co-running relation with the packaging film, a continuous length of plastic reclosable zipper assembly having interlocked fastener strips. Each of the fastener strips has a base or flange which is adapted to be secured, e.g., by heat sealing, to the film. At package length intervals, the interlocked fastener strips are spot sealed together. The co-running fastener assembly and film are oriented lengthwise so that the spot seals are located in alignment with the spaces between the product masses on the film. As the film with the co-running fastener strip assembly advances downstream from the loading station, the film is turned upon itself into a product mass-enclosing tube by a guiding device which brings the side edges of the film together into a fin over the row of product masses. The fin is sealed by means such as heat sealing bars. As the film is turned upon itself, a fold is formed enclosing the fastener strip assembly. In convenient coordination with the fin sealing bars, heat sealing bars seal areas of the film to the flanges of the fastener strips. As the film tube-enclosed product masses and fastener assembly advance further, the fin may be turned over and flattened by a roller. Then the generally tubular fastener assembly-equipped packaging assembly is cross sealed by means of heat sealing bars in alignment with the spaces between the product masses and the spot seals. This produces product-enclosing packages which are then successively separated from one another along the heat-sealed seams.

Figure 4:
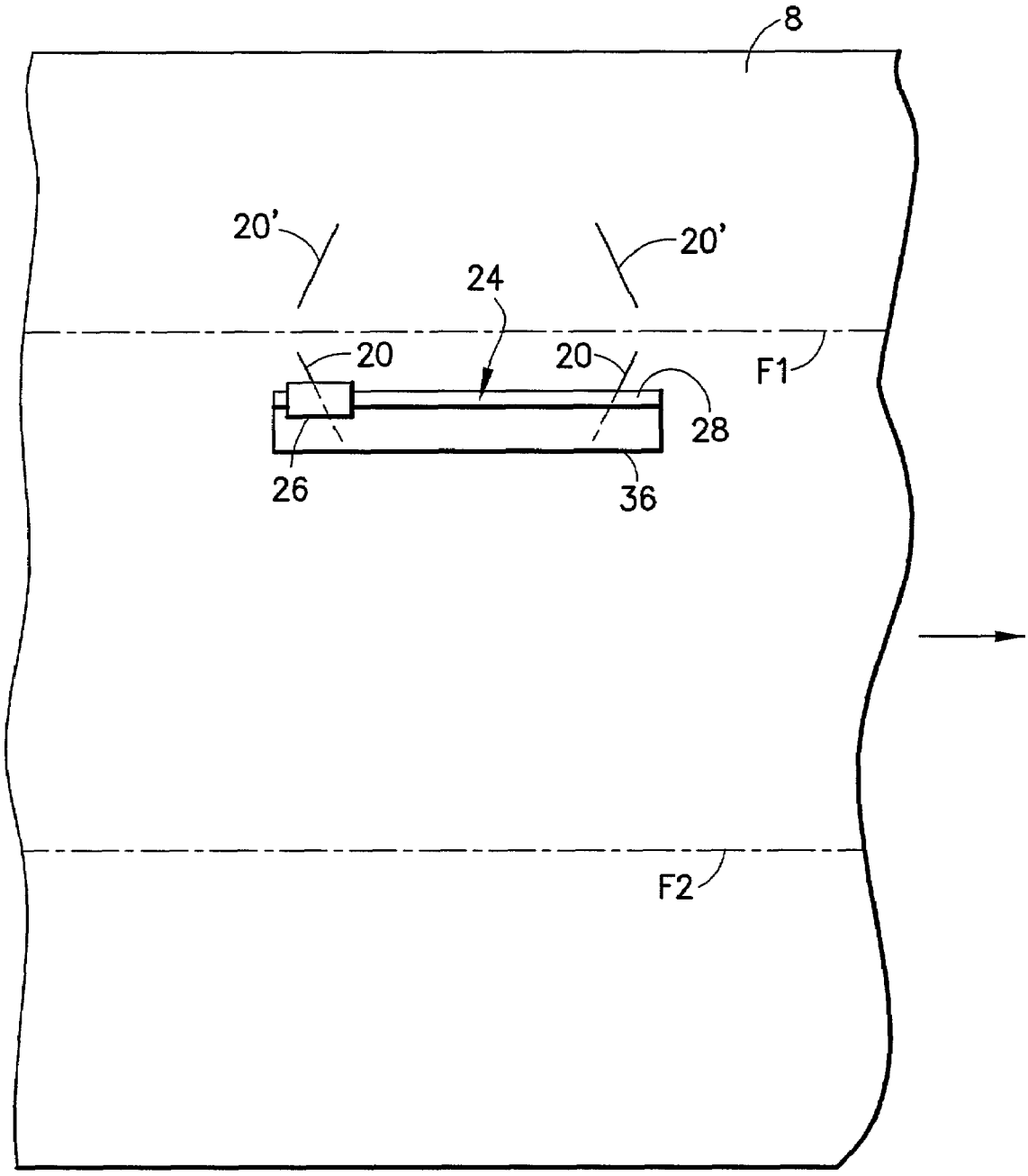
FIG. 4 is a drawing showing a fragmentary top view of a slide/zipper assembly attached to a slitted packaging film and oriented in a machine direction in accordance with another preferred method of packaging product on a form, fill and seal machine.

An HFFS method of the foregoing type can be supplemented in accordance with another preferred embodiment of the invention by automatically slitting the packaging film as shown in FIG. 4 prior to forming. Preferably, two slits 20 and two slits 20' are formed. Then the slider/zipper assembly 24/26 is attached to the film in overlying relationship to the slits 20. The film is then advanced to the folding station. The advancement of the packaging film occurs in the direction indicated by the arrow in FIG. 5. The fold lines are indicated by the dot-dash lines labeled F1 and F2 respectively. Preferably, the slits 20' are formed in mirror relationship to the slits 20 about the fold line F1. When the film is folded along fold lines F1 and F2, the slits 20' will generally overlie the corresponding slits 20. In the final package, the slits 20 and 20' will be part of an enclosed header. The slits 20 will be in the front wall of the header, while the slits 20' will be in the rear wall of the header.

Figure 5:
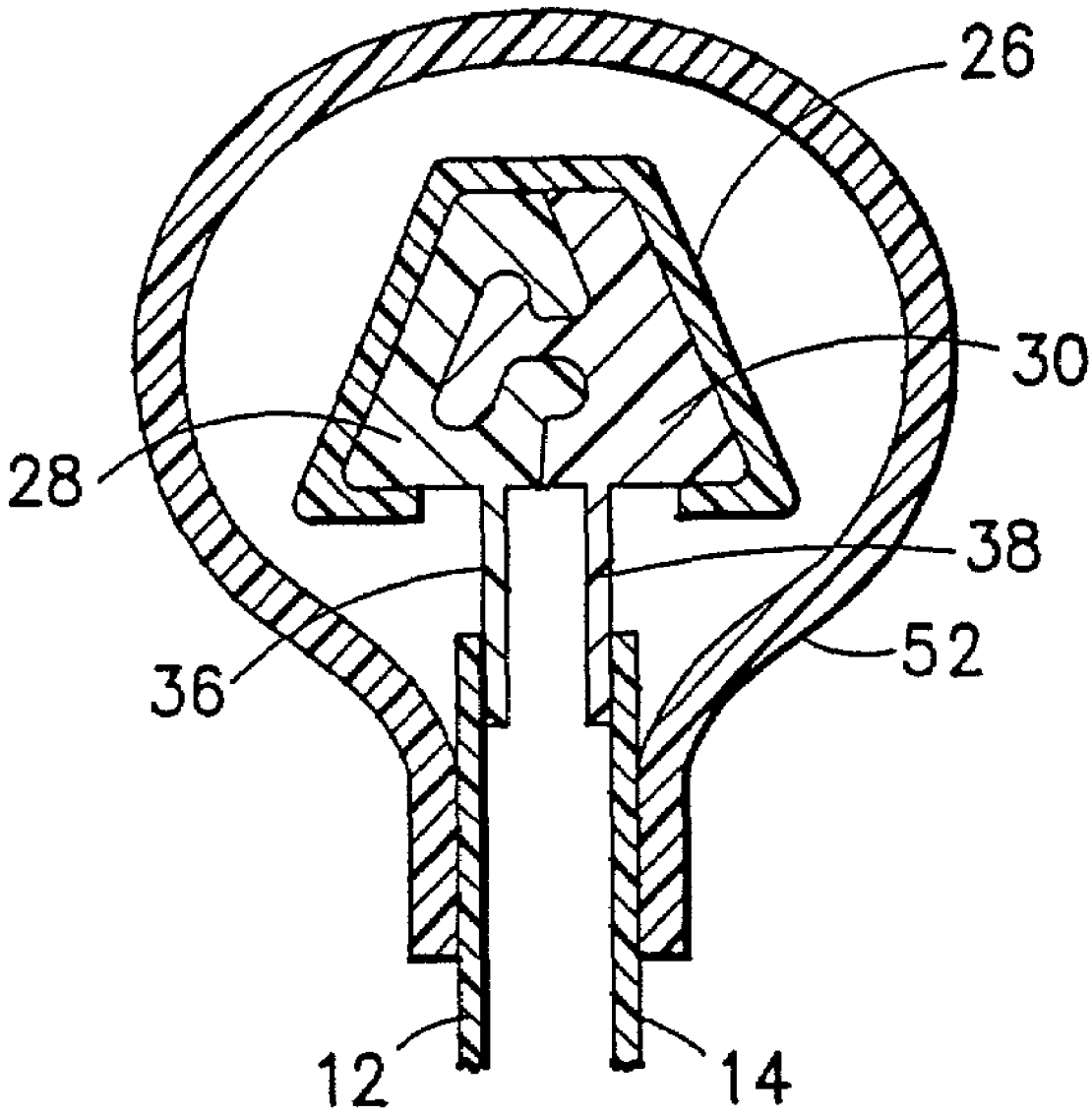
FIG. 5 is a drawing showing a fragmentary sectional view of the zippered portion of a reclosable package in accordance with another preferred embodiment of the invention.

Alternatively, the header can be made of a separate folded strip 52 hard sealed to the front and rear walls 12 and 14, as shown in FIG. 5. In this case, prior to attachment of the header, slits can be provided in the separate strip 52 in an arrangement similar to that shown in FIG. 4, to wit, that a pair of slits 20' will align with and overlie a pair of slits 20 when the separate strip is folded along a fold line. The slitted strip is then folded and heat sealed to the front and rear walls 12 and 14 of the receptacle as seen in FIG. 5. Lines of weakness are provided between the ends of the slits.

The preferred method of manufacture further comprises the step of forming lines of weakness in the packaging film along a line where the slits 20 are closest together (e.g., 22 in FIG. 1) and along a line where the slits 20' are closest together. Preferably, the lines of weakness are formed by perforations or laser scoring. The packaging film can be pre-perforated or pre-laser scored, or the perforating or scoring operation can be performed in the same station with the slitting operation, or the perforating or scoring operation can be performed in a separate station before or after the slits are made. The method further comprises the steps of forming tear notches along the side edges of each package at the slitting station or a different station before or after the slitting station.

While the invention has been described with reference to preferred embodiments, it will be understood by those skilled in the art that various changes may be made and equivalents may be substituted for members thereof without departing from the scope of the invention. In addition, many modifications may be made to adapt a particular situation to the teachings of the invention without departing from the essential scope thereof. For example, slits or lines of weakness may be substituted for tear notches at the side edges of the header; and lines of weakness may be substituted for slits. Therefore it is intended that the invention not be limited to the particular embodiment disclosed as the best mode contemplated for carrying out this invention, but that the invention will include all embodiments falling within the scope of the appended claims.

As used in the claims, the term "near", in the context of elevation, means that a tear propagating laterally from a tear notch (or slit) will meet or connect to a slit (or line of weakness) which is "near" in elevation; or that a tear propagating laterally from a slit (or line of weakness) will meet or connect to a line of weakness which is "near" in elevation. Also, as used in the claims, the term "tear notch" means a cutout, a cut line (i.e., slit) or a line of weakness (e.g., perforations).

The invention claimed is:

1. A package comprising a receptacle having a mouth at an upper end, a flexible zipper attached to said mouth and comprising first and second fastener strips, a slider movably mounted to said zipper for alternately opening or closing portions of said first and second fastener strips depending on the direction of movement of said slider relative to said zipper, said slider having a top at a first elevation and a bottom at a second elevation lower than said first elevation, and a header enclosing said zipper and said slider, wherein said header comprises first and second side edges and first and second walls each extending from said first side edge to said second side edge, said first wall of said header comprising:

a first line of weakness having a straight portion parallel to said zipper when said zipper is straight, said first line of weakness extending across said header at a third elevation that is lower than said second elevation; and a first slit defined in said first header wall by a pair of internal edges of equal length and separated by substantially no gap when said internal edges lie in a plane, said internal edges meeting at first and second termination points at opposite ends of said first slit, said first termination point being at a fourth elevation higher than said first elevation, and said second termination point being at a fifth elevation lower than said second elevation and at or near said third elevation.

2. The package as recited in claim 1, wherein said first slit is inclined at an angle in a range of 30 to 90 degrees relative to a line of said zipper.

3. The package as recited in claim 1, wherein said header further comprises a seal for sealing said first and second walls together.

4. The package as recited in claim 1, wherein said header is integrally formed with said receptacle.

5. The package as recited in claim 1, wherein said second wall of said header comprises:

a second line of weakness having a straight portion parallel to said zipper when said zipper is straight and extending across said header at a sixth elevation that is lower than said second elevation; and a second slit having first and second termination points at opposite ends thereof, neither of said first and second termination points of said second slit being located at one of said first and second side edges, said first termination point of said second slit being at a seventh elevation higher than said first elevation, and said second termination point of said second slit being at an eighth elevation lower than said second elevation and at or near said sixth elevation, said second slit being defined in said first header wall by a pair of mutually parallel internal edges of equal length and separated by substantially no gap when said internal edges lie in a plane.

6. The package as recited in claim 5, wherein said first and second lines of weakness are overlapping.

7. The package as recited in claim 5, wherein said first and second slits are overlapping.

8. The package as recited in claim 5, wherein lower end points of said first and second slits are closer together than are upper end points of said first and second slits.

9. The package as recited in claim 1, wherein said first header wall further comprises a tear initiator that starts at said first side edge at a sixth elevation higher than said first elevation.

10. The package as recited in claim 9, wherein said tear initiator is a tear notch.

11. The package as recited in claim 1, wherein said first line of weakness is a scoreline.

12. A package comprising a receptacle having a mouth at an upper end, a flexible zipper attached to said mouth and comprising first and second fastener strips, a slider movably mounted to said zipper for alternately opening or closing portions of said first and second fastener strips depending on the direction of movement of said slider relative to said zipper, said slider having a top and a bottom, and a header enclosing said zipper and said slider, wherein said header comprises first and second side edges and first and second walls each extending from said first side edge to said second side edge, said first wall of said header comprising:

a tear initiator that starts at said first side edge and terminates at a point located at a first elevation that is higher than said slider top;

a line of weakness having a straight portion parallel to said zipper when said zipper is straight, said line of weakness extending across said header at a second elevation that is lower than said slider bottom; and a slit defined in said first header wall by a pair of internal edges of equal length and separated by substantially no gap when said internal edges lie in a plane, said internal edges meeting at first and second termination points at opposite ends of said slit, neither of said first and second termination points being located at one of said first and second side edges, said first termination point being at or near said first elevation, and said second termination point being at or near said second elevation.

13. The package as recited in claim 12, wherein said tear initiator is a tear notch.

14. The package as recited in claim 12, wherein said line of weakness is a scoreline.

* * * * *